US009903548B2

(12) United States Patent
Creasman et al.

(10) Patent No.: US 9,903,548 B2
(45) Date of Patent: Feb. 27, 2018

(54) FIXTURE MOUNTING SYSTEM

(71) Applicant: Cree, Inc., Durham, NC (US)

(72) Inventors: Ethan Creasman, Raleigh, NC (US); Nathan Snell, Raleigh, NC (US)

(73) Assignee: Cree, Inc., Durham, NC (US)

( * ) Notice: Subject to any disclaimer, the term of this patent is extended or adjusted under 35 U.S.C. 154(b) by 500 days.

(21) Appl. No.: 14/539,088

(22) Filed: Nov. 12, 2014

(65) Prior Publication Data

US 2016/0131346 A1 May 12, 2016

(51) Int. Cl.

| | |
|---|---|
| ***F21S 8/00*** | (2006.01) |
| ***F21V 21/03*** | (2006.01) |
| ***G08G 1/095*** | (2006.01) |
| *F21Y 115/10* | (2016.01) |

(52) U.S. Cl.

CPC ..... *F21S 8/03* (2013.01); *F21V 21/03* (2013.01); *G08G 1/095* (2013.01); *F21Y 2115/10* (2016.08)

(58) Field of Classification Search

CPC ..... F21S 8/03; G08G 1/095; F21V 21/03
USPC ..... 362/145; 248/225.11, 224.8, 220.21; 29/428

See application file for complete search history.

(56) References Cited

U.S. PATENT DOCUMENTS

| | | | | |
|---|---|---|---|---|
| 7,213,940 | B1 | 5/2007 | Van De Ven et al. | |
| 8,591,062 | B2 | 11/2013 | Hussell et al. | |
| 2004/0095752 | A1* | 5/2004 | Hsu | F21S 8/04 362/147 |
| 2012/0026744 | A1* | 2/2012 | Peter | F21V 21/02 362/370 |
| 2012/0106149 | A1* | 5/2012 | Boa | F21V 3/04 362/235 |

* cited by examiner

*Primary Examiner* — Elmito Breval
*Assistant Examiner* — Naomi M Wolford
(74) *Attorney, Agent, or Firm* — Dennis J. Williamson; Moore & Van Allen PLLC

(57) ABSTRACT

A mounting system for a fixture includes a bracket configured to be mounted to a support structure that has at least one retaining member. A fixture is movably mounted to the bracket such that the fixture is movable between a first position and a second position relative to the bracket. The fixture includes at least one inclined surface engageable by the at least one retaining member such that movement of the fixture relative to the bracket between the first position and the second position moves the fixture toward the support structure.

20 Claims, 8 Drawing Sheets

FIXTURE MOUNTING SYSTEM

BACKGROUND

Mounting systems are used to mount fixtures such as light fixtures to a surface such as a ceiling or wall. In a typical system, electrical power is delivered to the fixture by electrical lines comprising conductors such as wires or the like that terminate in a junction box. The electrical lines may form part of the electrical system of a building where the lines carry current from the main electrical service into the building and deliver the power to dispersed locations throughout the building. The lines are connected to electrical conductors, such as wires or the like, of the fixture such that an electrical connection to the fixture may be completed at the junction box. Existing mounting systems for mounting fixtures to a junction box can be difficult and time consuming to install.

SUMMARY OF THE INVENTION

In one embodiment, a mounting system for a fixture comprises a bracket configured to be mounted to a support structure comprising at least one retaining member. A fixture is movably mounted to the bracket such that the fixture is movable between a first position and a second position relative to the bracket. The fixture comprises at least one inclined surface engageable by the at least one retaining member such that movement of the fixture relative to the bracket between the first position and the second position deforms the bracket and moves the fixture toward the support structure.

The bracket may comprise a mounting portion configured to secure the bracket to a support structure. The mounting portion may comprise a plate comprising at least one aperture. The mounting portion may comprise a plate comprising a plurality of apertures, at least one of the plurality of apertures may comprise an elongated slot. The at least one retaining member may comprise a first retaining member and a second retaining member. The first retaining member and the second retaining member may extend from a mounting portion. The first retaining member and the second retaining member may be disposed 180 degrees from one another relative to the mounting portion. The fixture may comprise a light source. The light source may comprise a removable LED lamp engageable with a socket or a plurality of LEDs that are permanently supported in the fixture. The light source may comprise a light transmissive cover. The fixture may comprise at least one slot arranged adjacent to the at least one inclined surface. The fixture may comprise a first inclined surface and a second inclined surface and a first slot arranged adjacent to the first inclined surface and a second slot arranged adjacent to the second inclined surface. A first retaining member and a second retaining member may be inserted into the first slot and the second slot, respectively, such that the fixture is movable relative to the bracket. The retaining members may apply a force to the inclined surfaces. A surface may be formed at an end of the inclined surfaces that is perpendicular to the direction of the force applied by the retaining members.

In some embodiments, a mounting system for a fixture comprises a resilient bracket configured to be mounted to a support structure comprising a first retaining member and a second retaining member. A fixture is movably mounted to the bracket such that the fixture is movable between a first position and a second position relative to the bracket. The fixture comprises a first inclined surface engageable by the first retaining member and a second inclined surface engageable by the second retaining member such that movement of the fixture relative to the bracket between the first position and the second position moves the fixture toward the support structure. A LED light source is supported by the fixture and an optically transmissive cover covers the LED light source.

The fixture may comprise a first slot receiving the first retaining member arranged adjacent to the first inclined surface and a second slot receiving the second retaining member arranged adjacent to the second inclined surface where the first slot and the second slot are shaped as an arc of a circle.

In some embodiments, a method of mounting a fixture comprises mounting a bracket comprising a retaining member on a support surface; inserting the retaining member into a slot on a fixture, the fixture comprising an inclined surface adjacent the slot; moving the fixture relative to the bracket such that the retaining member traverses the inclined surface such that the fixture is moved toward the support surface. The step of moving the fixture may comprise rotating the fixture.

DETAILED DESCRIPTION

Figure 1:
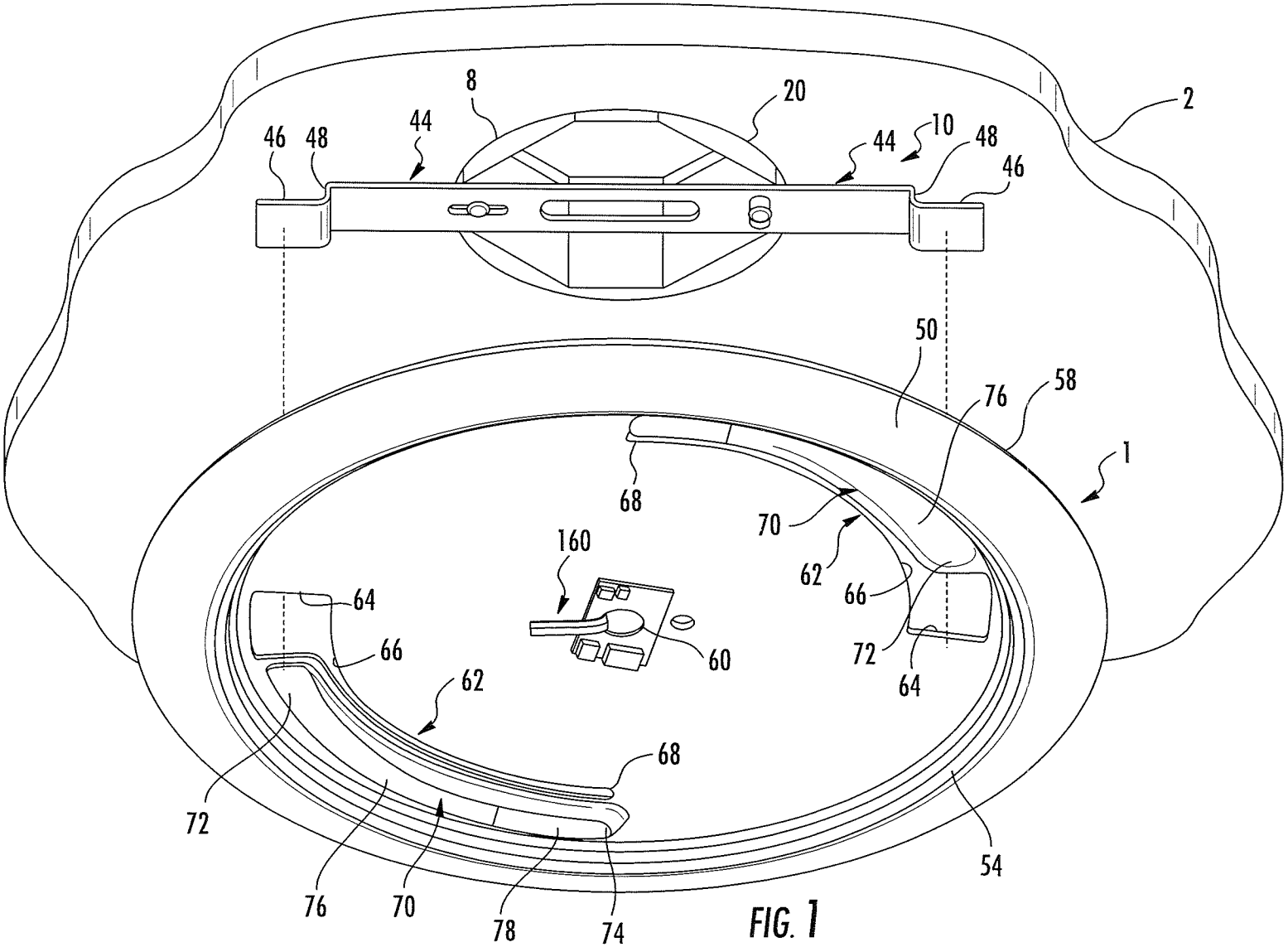
FIG. 1 is a perspective view showing an embodiment of the fixture mounting system of the invention in association with a junction box on a support surface.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The mounting system may be used to mount an electrical appliance such as light fixtures, ceiling fans, switches or other electrical components where the appliance may comprise a fixture that is mounted to a support structure 2 such as a ceiling or wall. In a typical system electrical power is delivered from a source of power, such as the main service into a building, by electrical lines 4 comprising conductors such as wires or the like 6 that terminate in a junction box 8. The electrical lines 4 may form part of the electrical system of a building where the lines carry current from the main electrical service into the building and deliver the power to dispersed locations throughout the building. The lines 4 are connected to the electrical conductors, such as wires or the like, of the fixture 1 such that an electrical connection to the electrical components of the fixture may be completed. The electrical connection may be required to be made at a junction box 8 by relevant safety standards such as fire and/or safety codes such that the electrical connection is isolated from the external environment.

Referring to FIGS. 1 through 7, one embodiment of a mounting system is shown. The mounting system comprises a bracket 10 that is mounted at the location where the electrical connection is to be made. As previously explained, the electrical connection is typically made at a junction box 8 such that the bracket 10 may be advantageously configured to mount to the junction box. In a typical arrangement of a junction box, the junction box 8 may comprise a metal or plastic housing 12 that defines a box having a peripheral wall 14 enclosed at one side by a back wall 16 and having an opening 18 opposite to the back wall 14 through which the electrical connection is made. The junction box 8 typically is fixed to the back side of a wall, ceiling, floor or other support structure 2 (hereinafter "support structure") by suitable fasteners (not shown) such as nails, screws or the like such that the box 8 is disposed in a hole 20 in the support structure 2 with the opening 18 of the junction box 8 accessible to a user. Electrical line 4 is connected to the junction box 8, typically at an aperture sometimes referred to as a knockout 22, such that electrical conductors such as wires 6 are fed into and terminate inside of the junction box 8. The conductors 6 may be contained in a conduit 11 such as a flexible or rigid metal or plastic conduit and a locknut or other similar structure (not shown) may be used to fix the conduit to the junction box 8. The junction box 8 typically comprises a plurality of engagement structures 30 comprising threaded bores or apertures for receiving fasteners 40, such as threaded screws, for mounting the fixture 1 to the junction box 8. In the typical junction box 8 the engagement structures 30 are disposed at the periphery of the housing 14 diametrically opposed to one another such that the engagement structures are arranged at opposite sides of the junction box in-line with one another. In some embodiments, the junction box 8 may have more than two engagement structures 30 arranged about the periphery of the housing 14.

Figure 6:
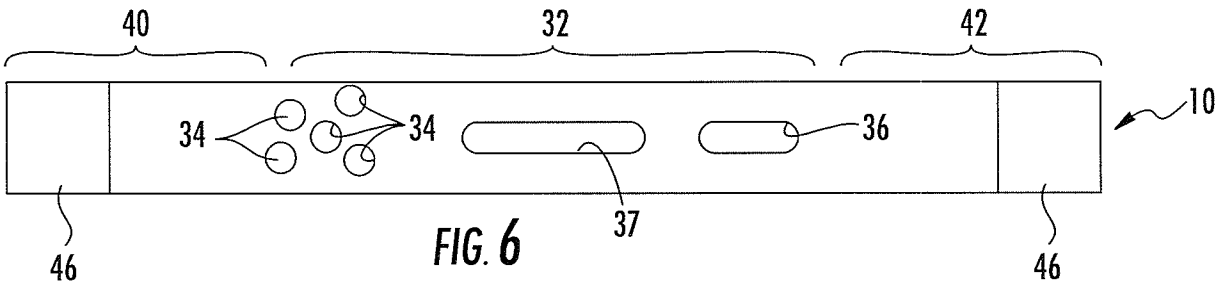
FIG. 6 is a plan view of an embodiment of a bracket used the mounting system of FIG. 1.
Figure 7:
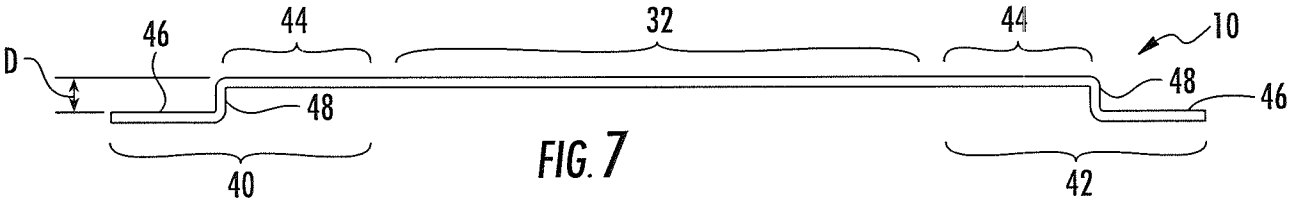
FIG. 7 is a side view of the bracket of FIG. 6.

Referring more specifically to FIGS. 6 and 7, the bracket 10 may comprise a mounting portion 32 for mounting the bracket to the junction box 8. The mounting portion 32 may comprise a plate that is configured to span the junction box 8 such that it is disposed over the engagement structures 30. In the illustrated embodiment, the mounting portion 32 comprises a relatively narrow flat plate that has a width wide enough to support the fixture and to be fixed to the junction box 8 but that allows access to the conductors 6. Apertures 34, 36 are formed at each end of the mounting portion 32 that may be aligned with the engagement structures 30 on the junction box 8. The apertures 34, 36 receive the fasteners 40 such that the bracket 10 may be fixed to the junction box 8 by the engagement of the fasteners 40 with the engagement structures 30. Because junction boxes may come in a variety of sizes and shapes, the apertures 34, 36 provided on the bracket 2 may have a universal configuration such that the bracket 10 may be mounted to a variety of different types, sizes and shapes of junction boxes. For example the apertures may be formed as elongated slots 36 such that the bracket 10 may be positioned relative to the junction box 8 to align the apertures with the engagement structures 30. The apertures may also comprise one or more circular apertures 34 dimensioned to closely receive a fastener 40 that are spaced such that one of the apertures 34 may be aligned with one of the engagement structures 30. While a plurality of apertures 34 are shown a single aperture 34 may be provided at one end of the mounting portion 32. In other embodiments, other combinations of such structures may be used.

For example both ends of the mounting portion 32 may be provided with a plurality of circular apertures 34 that are spaced such that one of the apertures at each end of the mounting portion 32 may be aligned with one of the engagement structures 30. In another embodiment both ends of the mounting portion 32 may be provided with elongated slots 36. In some embodiments an elongated 37 slot may be provided in the center of the bracket.

Figure 10:
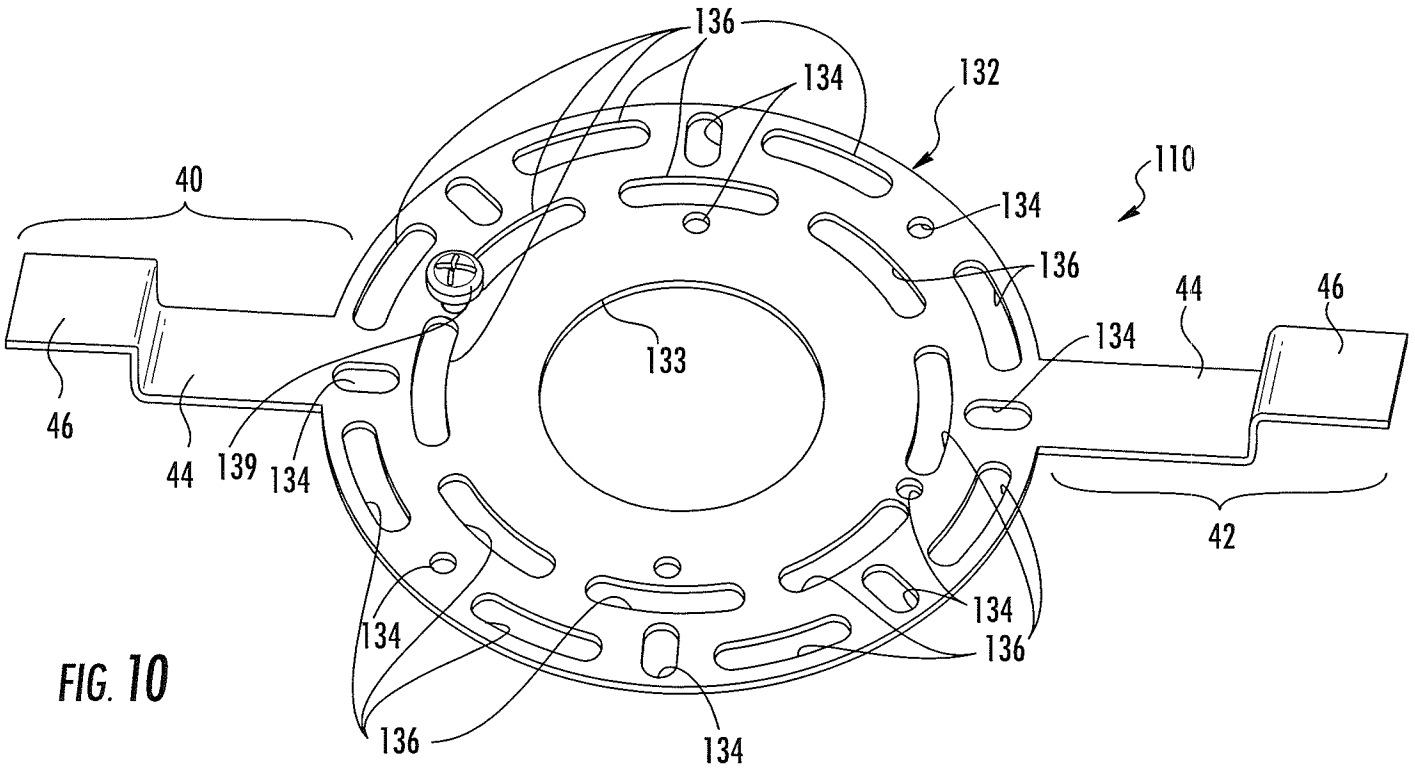
FIG. 10 is a perspective view of still another embodiment of a bracket usable in the mounting system of the invention.

In other embodiments, the mounting portion 32 may have other shapes and sizes and may be dimensioned to cover more or less of opening 18 of the junction box 8. As shown in FIG. 10, a bracket 110 comprises a mounting portion 132 that is configured to cover substantially the entire opening 18 of the junction box 8. In such an arrangement a central aperture 133 may be provided in the plate to allow access to the wires 6. The mounting portion 132 may be provided with a series of arcuate slots 136 disposed at different radii that extend for a portion of the mounting portion 132 and that are spaced and sized to be able to be aligned with the engagement structures 30 in the junction box 8. A plurality of circular and/or elongated slotted apertures 134 may be interspersed with the arcuate slots 136 such one of the apertures 134 or 136 may be aligned with engagement structures 30. In this and in other embodiments a screw 139 may be threaded to the bracket 10, 110 to provide a connection for a ground wire.

Configurations of the mounting portion 32, 132 other than those shown and described herein may be used to mount the bracket 10, 110 to a support structure may also be used. Moreover, while the invention is described with respect to one common application where a junction box 8 is used as the mounting structure for the bracket, the mounting portion 32, 132 may be secured to structures other than a junction box. While the mounting system for attaching a bracket 10, 110 to a junction box typically comprises a bore that receives a screw, the bracket may be attached to the junction box or other support structure using other mounting mechanisms.

The mounting portion of the bracket supports a retaining portion that engages a fixture 1 to mount the fixture 1 to the bracket 10. In one embodiment the retaining portion mounts the fixture in a flush mount against the structure 2. The retaining portion may comprise a first retaining portion 40 and a second retaining portion 42 that extend from the mounting portion 32, 132. In one embodiment the first retaining portion 40 and the second retaining portion 42 are disposed 180 degrees from one another relative to the mounting portion 32, 132 such that the retaining portions 40, 42 are disposed on opposite sides of the mounting portion 32, 132 and in-line with one another. The use of two retaining portions arranged as described balances the forces applied to the fixture 1 by the retaining members 46. While two retaining portions 40, 42 are shown disposed 180 degrees from one another the retaining portions may be arranged relative to one another at a spacing other than 180 degrees. Moreover, one, three or more retaining portions may be used that may be equally or unequally spaced from one another. For example, three retaining portions spaced from one another 120 degrees may be used.

Each retaining portion 40, 42 comprises a support member 44 that is connected to and extends from the mounting portion 32, 132 and that may be coplanar with the mounting portions 32, 132. The support members 44 may be configured to abut the support structure 2 when the bracket 10 is mounted in position. In a typical installation the open end 18 of the junction box 8 is mounted flush with the exterior surface of support structure 2 such that the support member 44 of the retaining portions 40, 42 and the mounting portion 32, 132 may be coplanar with one another. In other installations this arrangement may be changed to allow the mounting portion 32, 132 to be secured to the support structure and the support members 44 to abut the facing surface of the support structure.

Each retaining portion 40, 42 also comprises a retaining member 46 that is offset from the support member 44 a distance D such that a space is created between the retaining member 46 and the exterior surface of support structure 2 when the bracket 10 is mounted in position. In one embodiment the retaining members 46 are connected to the support members 44 by connecting flanges 48.

The bracket 10 may formed as a single, unitary, one-piece member. The bracket 10 may be formed into the desired shape by, for example, stamping, rolling and/or pressing a metal plate or by molding a plastic component. In other embodiments the bracket may be formed by multiple components secured to one another such as by welding or the like. In one embodiment the bracket 10, 110 is made of a flexible resilient material such that the bracket may be resiliently deformed during installation of the fixture 1. For example, the bracket may be made of a relatively thin plate of steel that allows the bracket to flex.

Figure 11:
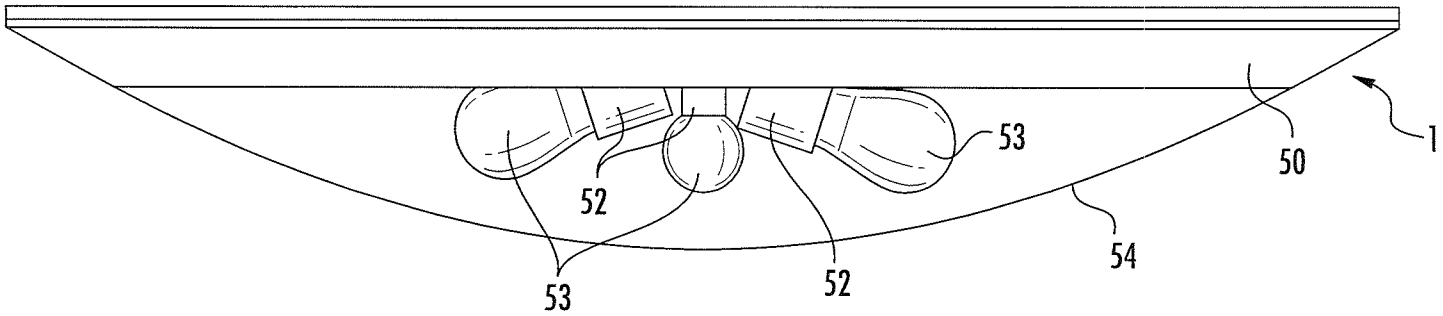
FIG. 11 is a side view of another embodiment of the fixture of the invention.
Figure 12:
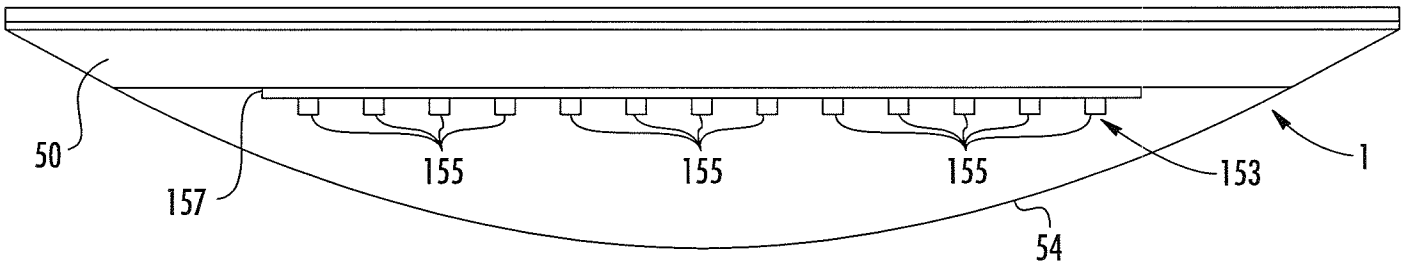
FIG. 12 is a side view of yet another embodiment of the fixture of the invention.

A fixture 1 is mounted to the support structure 2 using the bracket 10. The fixture may be used to mount any suitable electrically powered device. For example, as shown in FIG. 11 the fixture may form part of a light fixture where electrical sockets 52, such as Edison sockets, removably receive a light source 53 such as a light emitting diode (LED) lamp, incandescent or fluorescent bulb, or the like. One suitable LED lamp is shown and described in U.S. Pat. No. 8,591,062, issued on Nov. 26, 2013 to Hussell et al., which is incorporated by reference herein in its entirety, although any suitable LED lamp or other light source may be used. As shown in FIG. 12 the fixture 1 may also support a light source such as an LED light source 153 comprising a plurality of LEDs and/or LED packages 155 that are permanently supported in the fixture 1. The LED light source may comprise other optical elements such as wave guides, lenses or the like for creating a desired light emission pattern and/or light color. In some embodiments the electronics, or some of the electronics, for powering a LED lamp such as the power supply and drivers may be mounted on the fixture. The fixture 1 or portions of the fixture may be made of a thermally conductive material such as aluminum such that fixture acts as a heat sink to dissipate heat from the LED light source 153.

The term "LED" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

A lighting system using the combination of BSY and red LED devices referred to above to make substantially white light can be referred to as a BSY plus red or "BSY+R" system. In such a system, the LED devices used include LEDs operable to emit light of two or more different colors. A further detailed example of using groups of LEDs emitting light of different wavelengths to produce substantially while light can be found in issued U.S. Pat. No. 7,213,940, which is incorporated herein by reference.

With the embodiments described herein, as with many other embodiments of the invention, the term "electrical path" can be used to refer to the entire electrical path to the light source such as an LED light source, including an intervening power supply disposed between the electrical connection that would otherwise provide power directly to the LEDs and the LEDs, or it may be used to refer to the connection between the mains and all the electronics in the lamp, including the power supply. The term may also be used to refer to the connection between the power supply and the LEDs. The electrical path may include electrical conductors 160 such as wires in the fixture that may be electrically coupled to the wires 6 in the junction box 8 to complete the electrical connection to the light source or other electrical appliance.

As shown in FIG. 12, an example of an embodiment of a LED lamp is shown comprising a LED light source 153 provided with light emitting LEDs and/or LED packages 155. Multiple LEDs 155 may be used together, forming an LED array. The LEDs 155 can be mounted on or fixed within the lamp in various ways. In at least some example embodiments, a LED board 157 may be used to support the LEDs 155 and to form part of the electrical path to the LEDs. The LED board 157 may comprise a PCB, MCPCB, flex circuit, lead frame structure, flexible PCB or other similar structure. The LEDs 127 may comprise one or more LED dies disposed in an encapsulant such as silicone, and LEDs which may be encapsulated with a phosphor to provide local wavelength conversion. A wide variety of LEDs and combinations of LEDs may be used.

With respect to the features of the LED assembly and related electronic described herein with various example embodiments of a lamp, the features can be combined in various ways. The embodiments shown and described herein are examples only and are intended to be illustrative of various design options for a LED lighting system supported by fixture 1.

Figure 5:
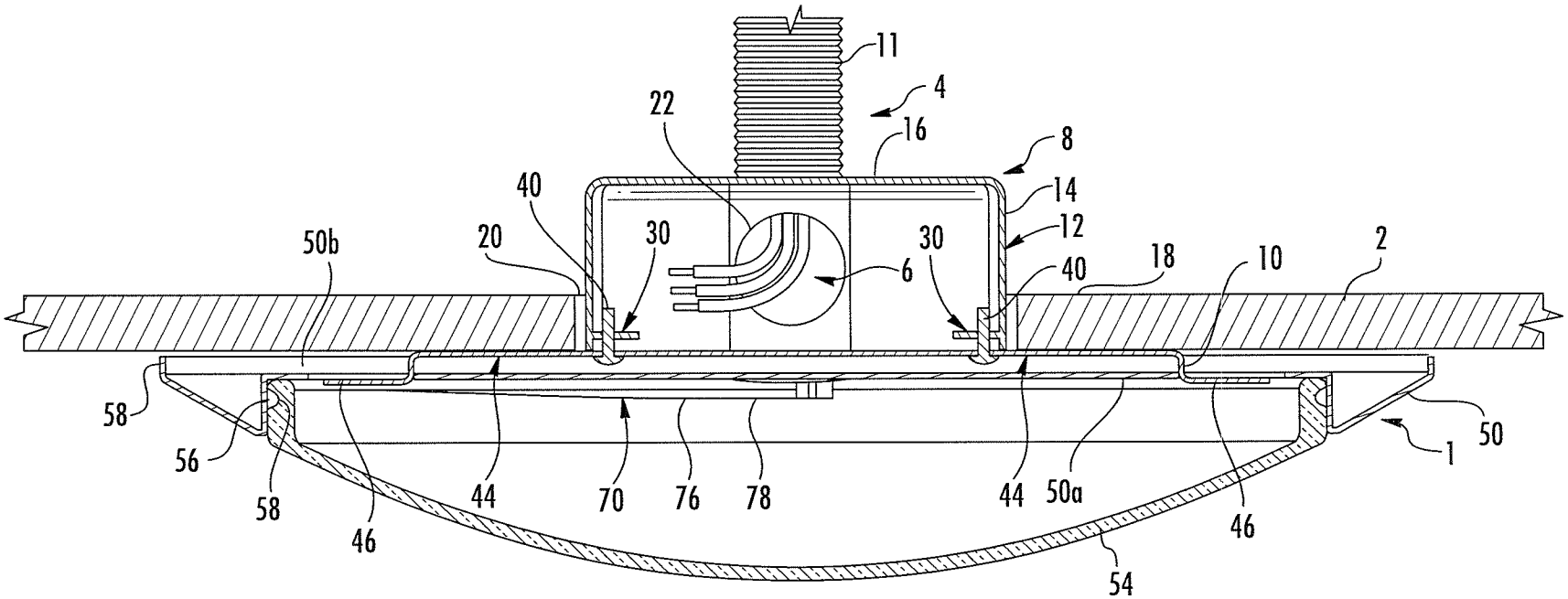
FIG. 5 is a section view of the fixture mounting system as shown in FIG. 2.

A light transmissive cover or lens 54 may cover the light source. The cover 54 may be permanently attached to the base 50 or the cover 54 may be removably mounted to the base 50 to allow the bulbs or lamps 53 to be removed and replaced. For example, as shown in FIG. 5 the cover 54 may be made of a relatively flexible material such as polycarbonate where the cover may be deformed or flexed slightly to allow male members 56 such as tangs formed on one of the base and cover to engage female members 58 such as detents formed on the other one of the base and cover 54. The male members 56 may be formed as a plurality of spaced protrusions and the female member 58 may be formed as a groove formed around the periphery of the cover. The cover 54 may include a light diffusive layer or properties to mix and diffuse the light from the fixture. The fixture may also form part of a ceiling fan, light switch/power switch, or other electrical appliance where the fixture 1 supports components other than or in addition to a light source.

The fixture 1 may comprise a base 50 dimensioned to cover the mounting bracket 10 and the junction box 8 and/or other mounting structure. In one embodiment the base 50 is formed as a relatively planar thin walled flat member; however, the base may have other configurations. The base 50 has an interior surface 50*a* and an exterior surface 50*b*. The base 50 may include an aperture 60 to allow the electrical conductors 160 such as wires to extend from the components in the fixture 1 to the exterior of the fixture where the wires may be electrically connected to the power lines 4.

Figure 4:
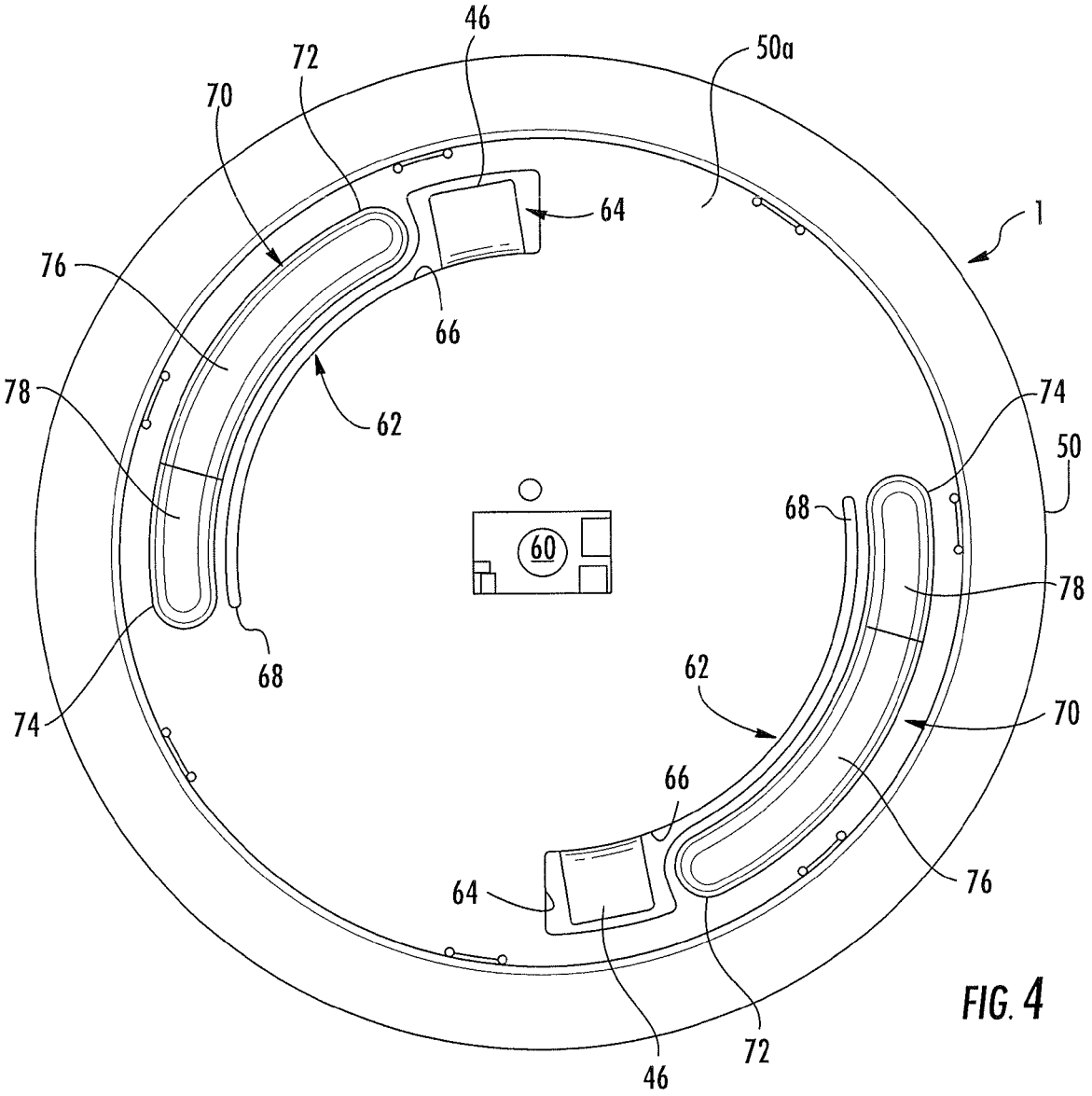
FIG. 4 is a plan view of the embodiment of the fixture mounting system of FIG. 1 in the first position.

Referring more particularly to FIGS. 4 and 5, the base 50 comprises keyed slots 62 arranged in a one-to-one relationship with the retaining portions 40, 42. In one embodiment, the slots 62 are disposed as an arc of a circle configured such that a retaining member 46 may be inserted into each of the slots 62 and the fixture 1 may be rotated relative to the bracket 10. The slots 62 have a large opening 64 at one end for receiving the retaining members 46. A narrower section of the slots 62 extend from a first end 66 adjacent the large opening 64 to a second end 68. The width of the slots 62 between the first end 66 and the second end 68 is dimensioned to closely receive the flanges 48 such that the flanges may slide in the slots but the fixture 1 is fixed against lateral movement relative to the bracket 10. While arcuate slots 62 are shown and described the fixture may use slots having other shapes such that the fixture 1 may be moved in other than a rotary motion to mount the fixture on the bracket 10. For example, the slots 62 may be linear such that the fixture 1 is moved in a linear direction relative to the bracket 10. Using a rotary motion allows the fixture to remain coaxially aligned with the junction box during installation; however, a linear movement may be used provided that the electrical connection may be maintained during installation and the fixture covers the bracket 10 and the junction box.

An ramp or camming surface 70 is positioned adjacent and extends alongside of each of the slots 62. Each ramp 70 has a first end 72 adjacent the first end 66 of slot 62 and a second end 74 adjacent the second end 68 of slot 62. The ramp 70 is arranged such that the retaining member 46 extends over or on top of the ramp as the fixture 1 is rotated relative to the bracket 10. The ramps 70 include angled surfaces 76 that extend away from the interior surface 50*a* of base 50 from the first end 72 of the ramp 70 to the second end 74 of the ramp 70. When the fixture 1 is mounted on the bracket 10 the angled surfaces 76 extend away from the bracket from the first end 72 of the ramp 70 to the second end 74 of the ramp 70.

Figure 2:
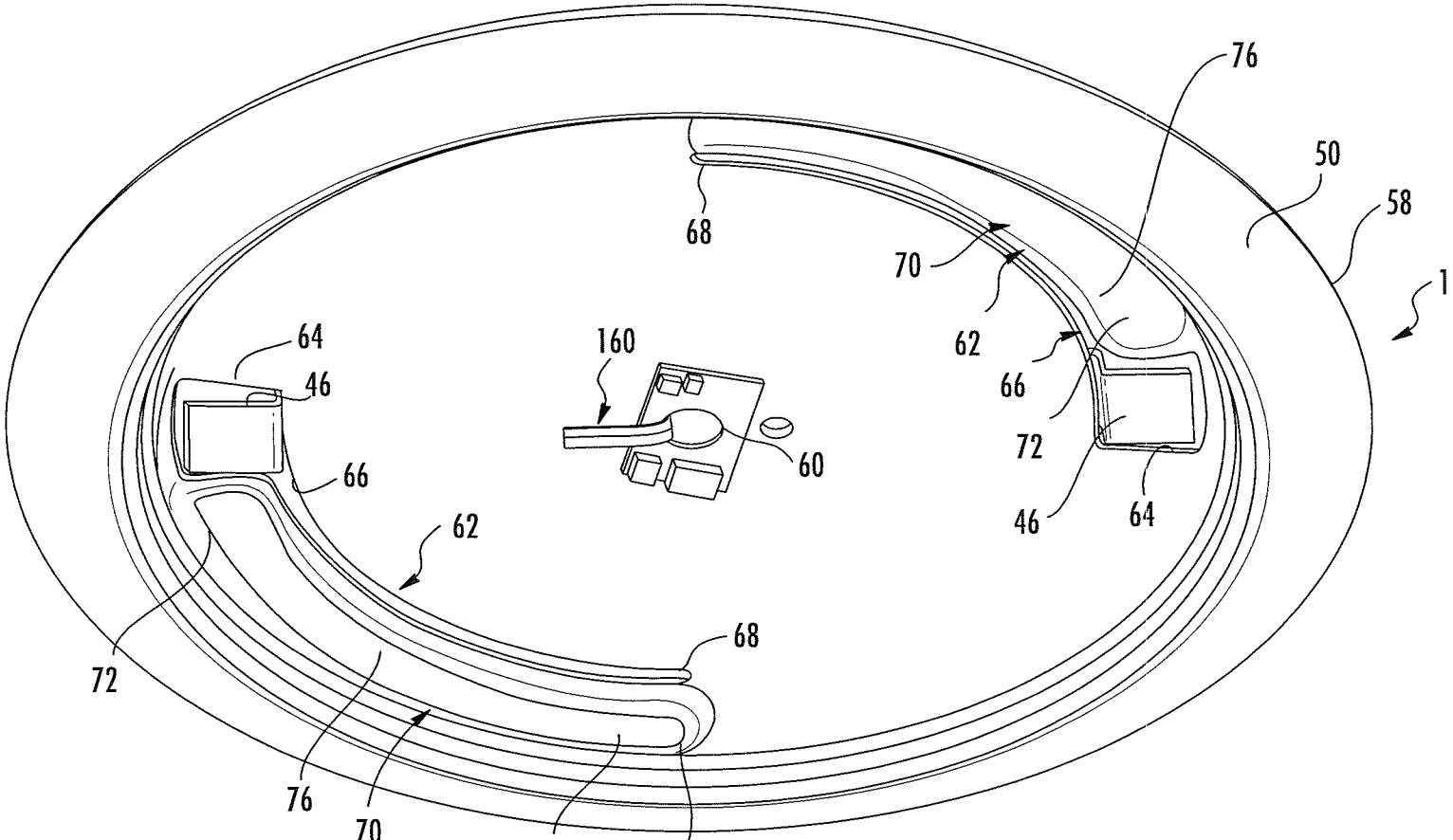
FIG. 2 is a perspective view showing the embodiment of the fixture mounting system of FIG. 1 in a first position.
Figure 3:
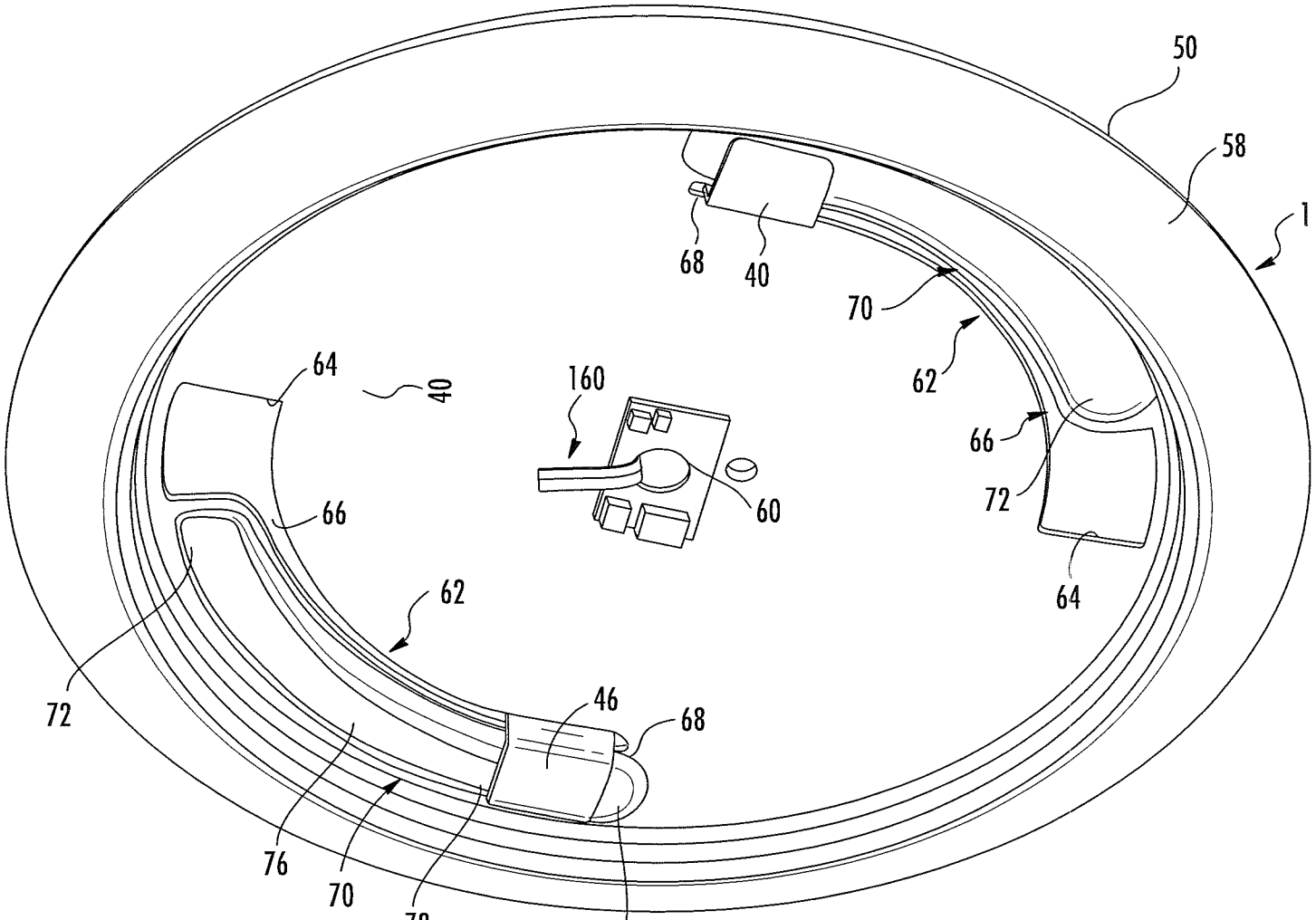
FIG. 3 is a perspective view showing the embodiment of the fixture mounting system of FIG. 1 in a second position.

To install the fixture 1 on the bracket 10, the retaining members 46 are inserted through the openings 64 and the exterior surface 50*b* of the base 50 is positioned over the bracket 10 in a first position (FIGS. 1, 2 and 4). The base 50 may include a rim 58 that extends beyond the base 50 such that the rim abuts the support structure 2 in a flush mount. The fixture 1 is rotated, or otherwise moved, relative to the bracket 10 to a second position (FIG. 3) such that the retaining members 46 traverse the slots 62 from the first end 66 to the second end 68. As the fixture 1 is rotated the inclined surface 76 of the ramp 70 engages the retaining members 46 such that the retaining members 46 exert a force on the ramps 70 that presses the fixture 1 against the support structure 2 as the fixture is rotated. The force exerted by the ramps 70 on the retaining members 46 deforms or flexes the bracket such that bracket exerts a force on the fixture using the resiliency of the bracket to hold the fixture in position once it is installed on the bracket. Because the inclined surfaces 76 of the ramps 70 extend away from the interior surface 50*a*, as the retaining members 46 traverse the ramps 70, the fixture 1 is pushed with increasing force against the support structure 2. While in one embodiment the resiliency of the material of the bracket is used to create the bias force on the fixture, the bias force may be created by a retaining member that is biased by a separate biasing mechanism such as a spring. For example, the retaining members 46 may be pivoted to the support members 44 at a pivot and a spring may be used to create the bias force between the retaining members and the ramps. At the end of each of the ramps 70 a flat surface 78 is formed that is perpendicular to the direction of the force applied by the retaining members 46 to the fixture 1. The flat surfaces 78 provide a stable resting surface for the retaining members 46 to prevent the fixture 1 from sliding or vibrating out of position relative to the bracket 10.

In some embodiments a stop such as a raised lip may be provided at the second end 74 of the ramp 70 to prevent the fixture 1 from being over rotated relative to the bracket 10. Further, a locking mechanism may be provided to lock the fixture 1 in position relative to the bracket 10. For example, one of the retaining members 46 and the ramps 70 may be provided with one or more raised areas such as tangs that matingly engage one or more recesses or detents formed on the other one of the retaining members 46 and the ramps 70. The tangs and recesses are dimensioned such that the engagement of the tangs with the detents prevent the fixture from rotating relative to the bracket after the fixture is mounted to the bracket but allow the fixture to be rotated relative to the bracket if a person applies a rotary force to the fixture such that the fixture may be removed if desired.

Figure 8:
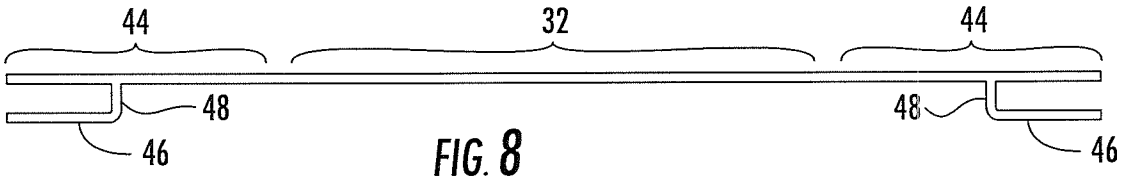
FIG. 8 is a plan view of another embodiment of a bracket usable in the mounting system of the invention.
Figure 9:
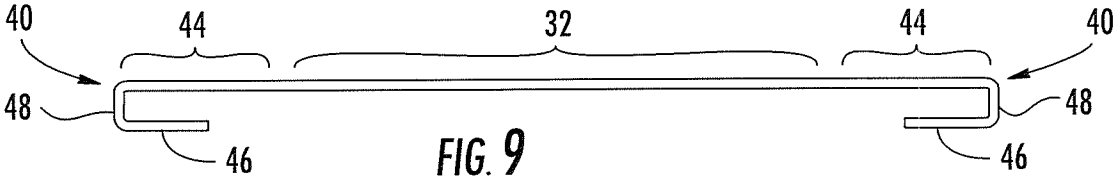
FIG. 9 is a plan view of yet another embodiment of a bracket usable in the mounting system of the invention.

Other embodiments of the bracket may be used. For example, as shown in FIG. 9 the retaining members 46 may extend back toward the support portion 32 such that a space is formed between the retaining members 46 and the support members 44. In this embodiment, the ramps 70 are formed to the inside of the slots 62 rather than to the outside of the ramps 70 as shown in the drawings. When the retaining member 46 is inserted into the slots 62 and the fixture 1 is rotated, the retaining members extend over the ramps to push the exterior back side of the fixture against the support structure as previously described. Another embodiment is shown in FIG. 8 that is similar to the embodiment of FIGS. 1-7 except that the support members 44 extend to the end of the retaining member 46 such that the spaces are formed between the retaining members 46 and the support members 44.

Numerous changes in the shape, size and configuration of the fixture 1 may be made. In some embodiments, such as in a light fixture, the base 50 and cover 54 may have a wide variety of ornamental finishes, styles, colors and shapes such that the fixture may be designed as an architectural feature.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A mounting system comprising:

a bracket configured to be mounted to a support structure comprising at least one retaining member;

a fixture movably mounted to the bracket such that the fixture is movable between a first position and a second position relative to the bracket, the fixture comprising at least one inclined surface engageable by the at least one retaining member such that movement of the fixture relative to the bracket between the first position and the second position deforms the bracket and develops a force that moves the fixture in direction perpendicular to and into engagement with the support structure.

2. The mounting system of claim 1 wherein the bracket comprises a mounting portion configured to secure the bracket to the support structure.

3. The mounting system of claim 2 wherein the mounting portion comprises a plate comprising at least one aperture.

4. The mounting system of claim 2 wherein the mounting portion comprises a plate comprising a plurality of apertures, at least one of the plurality of apertures comprising an elongated slot.

5. The mounting system of claim 1 wherein the at least one retaining member comprising a first retaining member and a second retaining member.

6. The amounting system of claim 5 wherein the first retaining member and the second retaining member extend from a mounting portion.

7. The mounting system of claim 6 wherein the first retaining member and the second retaining member are disposed 180 degrees from one another relative to the mounting portion.

8. The mounting system of claim 1 wherein the fixture comprises a light source.

9. The mounting system of claim 8 wherein the light source comprises a removable LED lamp engageable with a socket.

10. The mounting system of claim 8 wherein the light source comprises a plurality of LEDs that are permanently supported in the fixture.

11. The mounting system of claim 8 wherein the light source comprises a light transmissive cover.

12. The mounting system of claim 1 wherein the fixture comprises at least one slab arranged adjacent to the at least one inclined surface.

13. The mounting system of claim 1 wherein the fixture comprises a first inclined surface and a second inclined surface and a first slot arranged adjacent to the first inclined surface and a second slot arranged adjacent to the second inclined surface.

14. The mounting system of claim 13 wherein the at least one retaining member comprises a first retaining member and a second retaining member, the first retaining member and the second retaining member are inserted into the first slot and the second slot such that the fixture is movable relative to the bracket.

15. The mounting system of claim 1 wherein the at least retaining member applies a force to the at least one inclined surface where the fixture is pushed with increasing force against the surface as the fixture is moved between the first position and the second position.

16. The mounting system of claim 1 wherein a surface is formed at an end of the at least one inclined surface that is perpendicular to the direction of the force applied by the at least one retaining member.

17. A mounting system comprising:

a resilient bracket configured to be mounted to a support structure comprising a first retaining member and a second retaining member;

a fixture movably mounted to the bracket such that the fixture is a movable between a first position and a second position relative to the bracket, the fixture comprising a first inclined surface engageable by the first retaining member, the first inclined surface having a first end and a second end where the first inclined surface is configured to extend away from the support structure as the first inclined surface is traversed from the first end to the second end, and a second inclined surface engageable by the second retaining member, the second inclined surface having a third end and a fourth end where the second inclined surface is configured to extend away from the support structure as the second inclined surface is traversed from the third end to the fourth end, such that movement of the fixture relative to the bracket between the first position and the second position causes the first retaining member to traverse the first inclined surface from the first end toward the second end and the second retaining member to traverse the second inclined surface from the third end toward the fourth end such that the fixture is moved toward the support structure;

a LED light source supported by the fixture; and an optically transmissive cover covering the LED light source.

18. The fixture of claim 17 wherein the fixture comprises a first slot receiving the first retaining member arranged adjacent to the first inclined surface and a second slot receiving the second retaining member arranged adjacent to the second inclined surface, the first slot and the second slot shaped as an arc of a circle.

19. A method of mounting comprising:

mounting a bracket comprising a retaining member on a support surface;

inserting the retaining member into a slot on a fixture, the fixture comprising an inclined surface adjacent the slot;

moving the fixture relative to the bracket such that the retaining member traverses the at least one inclined surface such that a force is developed on the fixture that moves the fixture in a direction perpendicular to and into engagement with the support surface with increasing force as the fixture is moved between a first position and a second position.

20. The method of claim 19 wherein the step of moving the fixture comprises rotating the fixture.

* * * * *